US009919552B2

(12) United States Patent
Mueller

(10) Patent No.: US 9,919,552 B2
(45) **Date of Patent: *Mar. 20, 2018**

(54) METHOD AND DEVICE FOR REMOVING AT LEAST ONE BOOK CASE FROM A STREAM OF BOOK CASES CONVEYED ALONG A BOOK PRODUCTION LINE

(75) Inventor: Hans Mueller, Lauda-Koenigshofen (DE)

(73) Assignee: MUELLER MARTINI HOLDING AG, Hergiswil (CH)

( * ) Notice: Subject to any disclaimer, the term of this patent is extended or adjusted under 35 U.S.C. 154(b) by 395 days.

This patent is subject to a terminal disclaimer.

(21) Appl. No.: 13/440,689

(22) Filed: Apr. 5, 2012

(65) Prior Publication Data

US 2012/0255889 A1 Oct. 11, 2012

Related U.S. Application Data

(60) Provisional application No. 61/505,231, filed on Aug. 2, 2011.

(30) Foreign Application Priority Data

Apr. 7, 2011 (CH) ..... 637/11

(51) Int. Cl.
*B42C 11/04* (2006.01)
*B07C 5/38* (2006.01)
(Continued)

(52) U.S. Cl.
CPC ..... *B42C 11/04* (2013.01); *B07C 3/14* (2013.01); *B07C 5/38* (2013.01); *B65H 29/62* (2013.01);
(Continued)

(58) Field of Classification Search
CPC ..... B07C 5/3412; B07C 5/38; B07C 3/14; B42C 11/04; B42C 19/00; B42C 19/05;
(Continued)

(56) References Cited

U.S. PATENT DOCUMENTS 3,816,866 A 6/1974 Miaskoff et al.
5,295,775 A 3/1994 Andjelic et al.
(Continued)

FOREIGN PATENT DOCUMENTS

CH 00759/10 A 10/1917
CN 101269761 A 9/2008
(Continued)

OTHER PUBLICATIONS

International Search Report for related Swiss Patent Application No. 00637/11 dated Jul. 13, 2011.
(Continued)

*Primary Examiner* — Joseph C Rodriguez
*Assistant Examiner* — Kalyanavenkateshware Kumar
(74) *Attorney, Agent, or Firm* — FisherBroyles, LLP; Robert Kinberg

(57) ABSTRACT

A book case processing portion of a book production line forms a combination with a device for the removal of at least one book case from a stream of book cases conveyed in a main conveying direction along the book case processing portion of the book production line. The device includes a deposit tray that is extendible into the stream to remove the at least one book case from the stream of book cases.

12 Claims, 6 Drawing Sheets

(51) Int. Cl.

| | |
|---|---|
| ***B07C 3/14*** | (2006.01) |
| ***B65H 29/62*** | (2006.01) |
| *B07C 5/34* | (2006.01) |
| *B42C 19/00* | (2006.01) |

(52) U.S. Cl.
CPC ..... *B07C 5/3412* (2013.01); *B42C 19/00* (2013.01); *B65H 2511/25* (2013.01); *B65H 2511/512* (2013.01); *B65H 2511/52* (2013.01); *B65H 2513/42* (2013.01); *B65H 2701/1768* (2013.01)

(58) Field of Classification Search
CPC ..... B65H 2411/512; B65H 2411/25; B65H 29/62; B65H 2301/437
USPC ..... 209/547, 552, 583, 657; 412/11, 1, 412/19–21; 270/52.02, 52.03, 52.14, 270/52.16
See application file for complete search history.

(56) References Cited

U.S. PATENT DOCUMENTS

| | | | | |
|---|---|---|---|---|
| 5,716,190 | A * | 2/1998 | Rathert | 414/794.3 |
| 6,206,358 | B1 | 3/2001 | Yamaguchi et al. | |
| 7,325,375 | B2 | 2/2008 | Graushar et al. | |
| 7,441,762 | B2 | 10/2008 | Kearns | |
| 7,475,523 | B2 | 1/2009 | Graushar et al. | |
| 7,758,036 | B2 | 7/2010 | Levine et al. | |
| 8,475,104 | B2 * | 7/2013 | Mueller | 412/13 |
| 8,498,730 | B2 | 7/2013 | Henry | |
| 8,517,656 | B2 | 8/2013 | Hartshorne et al. | |
| 8,579,274 | B2 | 11/2013 | Mueller | |
| 8,919,758 | B2 * | 12/2014 | Mueller | B42C 11/04 270/52.02 |
| 9,199,505 | B2 * | 12/2015 | Mueller | B42C 11/04 |
| 2001/0015263 | A1 * | 8/2001 | Rathert | 156/538 |
| 2008/0031706 | A1 | 2/2008 | Silberbauer | |
| 2011/0280688 | A1 | 11/2011 | Mueller | |
| 2013/0064626 | A1 | 3/2013 | Buntemeyer et al. | |

FOREIGN PATENT DOCUMENTS

| | | | |
|---|---|---|---|
| DE | 197 29 529 | A1 | 3/1998 |
| DE | 102008034065 | A1 | 2/2010 |

OTHER PUBLICATIONS

First Office Action in Chinese Patent Application No. 20120098982.3, dated Jan. 14, 2015.

* cited by examiner

METHOD AND DEVICE FOR REMOVING AT LEAST ONE BOOK CASE FROM A STREAM OF BOOK CASES CONVEYED ALONG A BOOK PRODUCTION LINE

CROSS REFERENCE TO RELATED APPLICATION

This application claims the priority of Swiss Patent Application No. 00637/11, filed on Apr. 7, 2011, as well as U.S. Provisional Patent Application No. 61/505,231, filed on Aug. 2, 2011, the subject matter of which is incorporated herein by reference.

BACKGROUND OF THE INVENTION

Conventional book production lines join or marry respectively one book block and one book case in a clocked operation. In the process, the book blocks and the associated book cases are normally first produced in separate machines. With the conventional book production lines, for example, as disclosed in German patent document DE 19729529 A1, the book block first travels separately from the associated book case to the processing stations for rounding, backing, spine glue application, headbanding and the like. The book case generally passes through a case bending device before the so-called marriage takes place in a downstream-arranged casing-in machine, i.e. before the book case and the book block are joined.

Conventional book production lines of this type operate based on the premise of a production of medium to large book editions. For a series of two or more book blocks, an equal number of book cases are therefore provided, where it is not necessary to observe a specific sequence because one book is composed in the same way as another book within a single edition.

When producing small editions of personalized books, for example, books of photographs, the book block as well as the book case are unique items. A small edition, therefore, requires an unambiguous identification of the book case and the book block, where reference to this is made in German patent document DE 102008034065 A1.

To obtain non-problematic processing of small editions in a conventional book production, where this refers to a throughput range of 3600 hardcover books per hour, for example, either the book case or the book block must take on a control function. A section of the book to be produced therefore predetermines for the book production line which other section of the later book must be joined to it. Swiss patent document CH 00759/10 deals with the problems of a targeted and flexible incorporation of a section of a book which is produced in a small edition into a book production line, as well as the secure allocation of the sections to be married. The aforementioned document proposes creating task stacks comprising book cases of a known composition for which the case information is made available to the book production line in the form of a single marking for the task stack.

When operating conventional book production lines, as generally understood in the art, it has turned out that in some cases individual book cases and/or book blocks must be removed. However, this cannot be realized when using book production lines configured based on conventional designs. Those cases include, for example, if the book cases and the book blocks must travel different distances along the book production line. For example, if twelve book blocks are located inside processing stations during the operation, while only three book cases have already been deposited. It is possible that the matching book blocks for the book cases located in the book production line are not available. Other irregularities are also conceivable, for example, that a section of a book is damaged in a processing station or that different quality problems are detected. It may be desirable to transfer out a section of the book before a marriage to the book cover takes place.

In the event that book blocks are missing in the ascending and/or descending sequence for the book blocks in the processing chain, an empty cycle is assigned to this missing book block and the associated case is transferred out at the respective location.

SUMMARY

It is an object to provide a method and device for the removal of individual book cases from a feeding stream conveyed along a conventional book production line, if possible without interrupting the conveyed stream. The solution should, furthermore, not require additional space. It is a further object that a quick intervention in the book production line should not be made more difficult, meaning that the conveying sections should remain easy to access, if possible.

The above and other objects are accomplished according to one aspect of the invention wherein there is provided a method for production of books, in particular for producing small book editions, which, in one embodiment, includes supplying a stack of book cases in a stream along a book production line in a main transporting direction; supplying a plurality of book blocks successively along the book production line; identifying a marking by an identification device on each of the book blocks and book cases; transmitting an identified marking on at least one book case to a machine control of the book production line; assigning, as a result of the marking on the at least one book case, a dataset stored in the machine control for a sequence of book cases to the supplied stack, where the assigning of the dataset is done by one of the machine control or an operator; determining, based on the identified markings of the supplied book blocks, a sequence in the machine control for book blocks positioned on the book production line; comparing the dataset for the sequence of the book cases to the sequence of the book blocks; and if, based on the comparison, at least one book block is missing, relative to the sequence for the book cases, removing at least one book case from the stream of book cases that corresponds to the at least one missing book block, using the machine control.

According to one embodiment, the books produced with the aid of the book production line are composed of at least one book block and a rigid or hardcover book case, adapted to protect the book block. The book block and the book case may be transported to the location of the marriage either parallel to each other and coming from the same direction, or coming from different directions.

According to an embodiment, markings on the book blocks, as well as on the book cases, may be initially identified. Subsequently, the at least one book case may be removed in dependence on an evaluation of the previously made identification in a machine control unit.

According to another embodiment, following the feeding of a stack of book cases and a number of book blocks to the book production line, the marking on at least one book case in the conveyed stream positioned on the book production line may be identified and the identified marking may be subsequently transmitted to the machine control. Based on the marking identified on this one book case, the machine control may assign to the supplied stack a dataset, stored in the machine control, for the sequence of the book cases in this stack, where this dataset may be assigned automatically or by an operator to the supplied stack. During this process, the dataset may be simply activated, for example through an operator action, or the operator may actually trigger the data transmission through a corresponding action. Owing to the markings on the supplied book blocks, a sequence for these book blocks may be determined in the machine control and may be compared to the dataset for the sequence of the book cases. As a result of this comparison and if at least one book block is missing, relative to the sequence for the book cases, the machine control may trigger the removal of at least one book case which corresponds to the at least one missing book block.

According to one embodiment, one or more book cases may be transferred-out and temporarily stored in a cost-effective manner, without interrupting the book production process. At the completion of a work order, cases that have been removed can be supplied again in the exact same sequence to a magazine for holding the cases. The data and/or the sequence for the transferred-out cases may be identified by the machine control and can be taken over.

According to one embodiment, the at least one book case may be removed following a case bending operation.

According to another embodiment, one of the book cases may be removed while the cases are dropping out of a processing device that is arranged along the book production line, for example, but not limited to, a case bending device. For this, a deposit tray or stacker tray may be moved into the flight trajectory for the book cases to catch and accommodate the at least one book case.

The application, furthermore, relates to a book case prossessing portion of a book production line forming a combination with a device for removal of at least one book case from a stream of book cases conveyed in a main conveying direction along the book case processing portion of the book production line. The device, in one embodiment, includes a deposit tray that is extendible into the stream to remove the at least one book case from the stream of book cases.

According to one embodiment, the deposit tray may have an essentially rectangular shape, as seen from above, with an exposed or unattached end in an upstream direction and an attachment end in a downstream direction. In the end region where it is attached, the deposit tray may be positioned articulated in the book production line. The deposit tray may be adapted to move from an upper idle position in which it has no contact with the conveyed stream of book cases to a lower catching position where it is in contact with the conveyed stream of book cases.

According to another embodiment, the deposit tray may include a center tray section and angled sections that are positioned adjacent thereto. The center tray section and the angled sections may be oriented parallel to the main transporting direction for the book cases.

According to a different embodiment, the deposit tray may include an axis of rotation, formed perpendicular to the main transporting direction, for the articulated positioning in the region of the attachment end.

According to one embodiment, the deposit tray may be connected with positioning bearings at its attachment end to the book production line, such that it can be displaced linear and parallel to the main transporting direction. The deposit tray may be adapted to suspend with positioning bearings from format-dependent, adjustable guide plates for the book production line.

According to another embodiment, the deposit tray may be fitted onto a hinge mechanism, with its exposed end facing the conveyed stream of book cases.

These embodiments of the deposit tray have advantages because the deposit tray can thus be inserted and removed quickly, without high assembly expenditure, and consequently does pose an obstacle to format changes for the book cases conveyed in the book production line and/or can adapt to these format changes.

According to one embodiment, the hinge mechanism may include at least one cylinder, positioned pivoting in a plane parallel to the main transporting direction and perpendicular to the deposit tray. The cylinder may include an exposed end which faces the exposed end of the deposit tray. An adjustment mechanism of this type is suitable for making quick adjustments to the deposit tray.

BRIEF DESCRIPTION OF THE DRAWINGS

The present invention will be more readily understood from the following detailed description when read in conjunction with the accompanying drawings, in which.

The figures show various embodiments of the invention, where similar components are given the same reference numbers and not all figures include all reference numbers.

DETAILED DESCRIPTION

Figure 1:
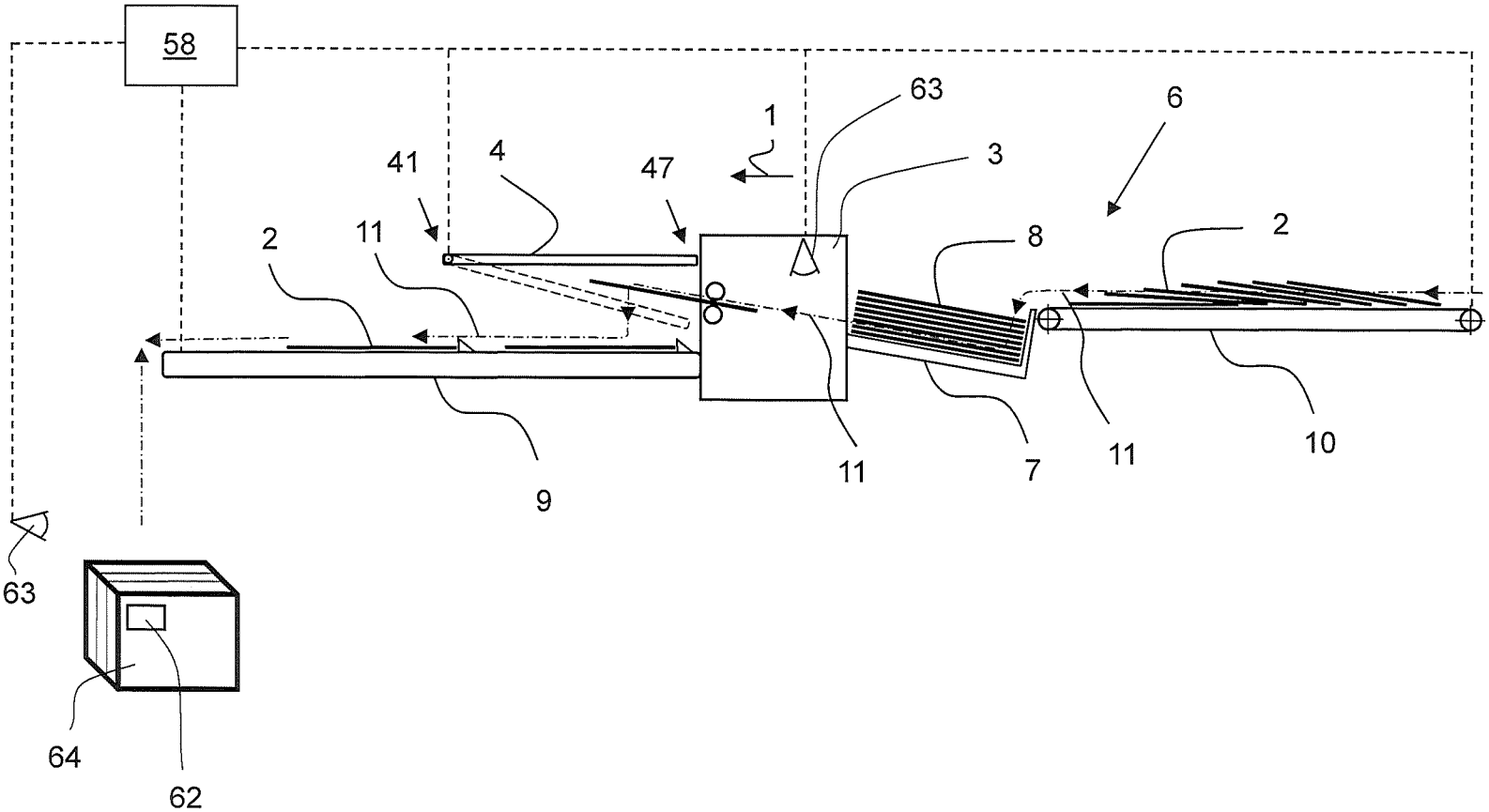
FIG. 1 is a schematic view of a portion of the book production line according to an embodiment of the invention.
Figure 2:
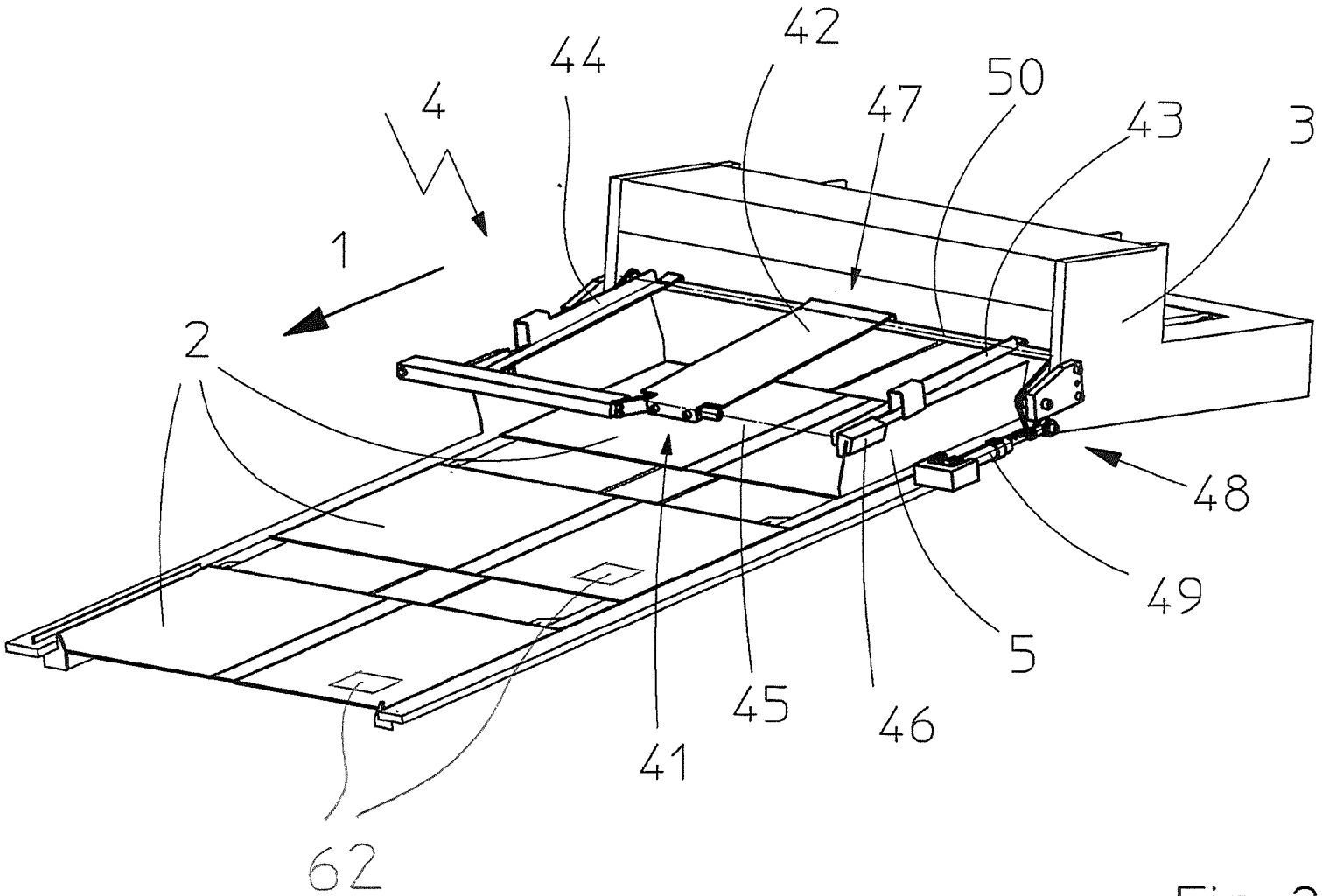
FIG. 2 is a perspective view of a device on the book production line according to an embodiment of the invention, where the device is in an idle position.
Figure 3:
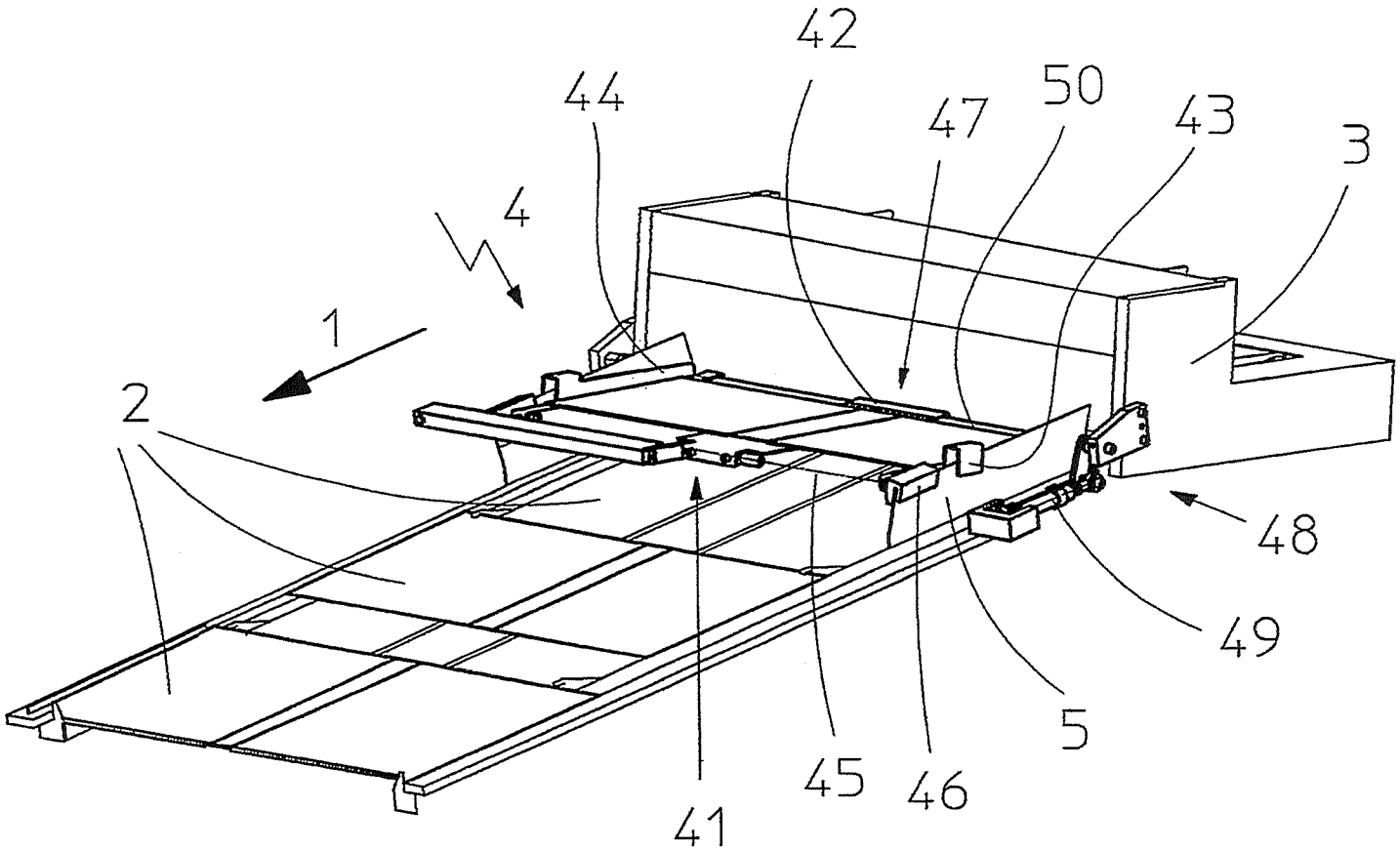
FIG. 3 is a perspective view according to FIG. 2, where the device is in the catching position.

In a book production line 6, book blocks 61 are married to the respective book cases 2, to form finished books. FIG. 1 shows a portion of a book production line 6, with a case bending device 3 in which the book cases 2 are bent such that following the joining with the book block 61 and the drying operation, they assume their flatness. Arranged upstream of the case bending device 3 is a case magazine 7 for accommodating a stack 8 of book cases 2, where the book cases 2 are separated out from the stack 8 and conveyed further to the case bending device 3. Adjoining the case bending device 3 in a downstream direction is a conveying section 9 in the form of a pusher, which includes side-mounted guide plates 5, as shown in FIGS. 2 and 3, which function to guide the book cases 2. Two correspondingly bent book cases 2 with a gap disposed in-between are located on the conveying section 9.

Initially, a stack 8 of book cases 2 is deposited either directly into the case magazine 7 or the book cases 2 are positioned in the form of an overlapping flow onto a conveying belt 10, arranged upstream of the case magazine 7. In the latter case, the book cases 2 are conveyed with the aid of the conveying belt 10 to the case magazine 7 where a stack 8 is again formed. Starting with the supplied stack 8, the book cases 2 are thus transported in the form of a conveyed stream 11, shown in FIG. 1 with a dash-dot arrow, via the case magazine 7, the case bending device 3 and the conveying section 9 to the location of marriage with the respective book blocks 61, wherein this location is not shown herein.

According to an embodiment, the device for the removal of a book case from the stream of book cases may be in the form of a deposit tray 4, for example, a catching flap, which may be arranged above the conveying section 9 and, as seen in the main transport direction 1 for the cases 2, directly downstream of the case bending device 3. FIG. 1 shows the deposit tray 4 with solid lines in an upper idle position and with dashed lines in a lowered catching position, relative to the idle position. The book production line 6 furthermore includes a machine control 58 which is connected to the deposit tray 4, the case bending device 3, the conveying section 9 and the conveying belt 10.

FIGS. 2 and 3 show perspective views of the deposit tray 4, as well as the components of the book production line 6, which are arranged directly upstream and downstream of the deposit tray 4. The deposit tray 4 is shown in FIG. 2 in the idle position and in FIG. 3 in the catching position where it is lowered from the idle position.

A top perspective view shows that the deposit tray 4 has an essentially rectangular shape, with an exposed end 47 in an upstream direction and an attachment end 41 in a downstream direction. In the main transporting direction 1, the deposit tray 4 furthermore includes two angular tray sections 43, 44, a center tray section 42, as well a rod 50, at its exposed end 47, which faces the case bending device 3. In a region below the conveying section 9, one cylinder 49 which is attached articulated on at one end is positioned respectively on each side of the deposit tray 4, meaning on the operating side as well as the opposite-arranged frame side. The rod 50 is adapted to be lowered with the cylinder 49 to the catching position and raised to the idle position.

The center tray section 42 is embodied as a flat plate which can be placed onto the rod 50 at the exposed end 47 of the deposit tray 4. For this, the center tray section 42 is bent over or tilted at the exposed end 47 of the deposit tray 4 with a radius corresponding to that of the rod 50. On the side facing away from the case bending device 3, the center tray section 42 is positioned suspended at the attachment end 41 of the deposit tray 4, such that it can rotate around an axis 45.

The deposit tray 4 is suspended on both sides from the guide plates 5, with the aid of the angular tray sections 43, 44. For this, the angular tray sections 43, 44 include adjustable bearings 46 which are arranged displaceable in the main transport direction 1 on the guide plates 5. The angular tray sections 43, 44 furthermore include respectively one vertical wall 52 (See FIGS. 4 and 5) for guiding the deposit tray 4 on the side along the guide plates 5 during the pivoting from the idle position to the catching position and vice versa. At the exposed end 47 of the deposit tray 4, the angular tray sections 43, 44 are embodied similar to the center tray section 42, meaning they can be suspended from the rod 50.

At the attachment end 41 for the deposit tray 4, the center tray section 42 is adapted to rotate around the axis 45 and is connected to a non-depicted frame of the book production line 6. The angular tray sections 43, 44 are positioned rotating in the adjustable bearings 46, meaning they also rotate around the axis or rotation 45.

During the operation of the book production line 6, the book cases 2 are conveyed in a stream 11 to the case bending device 3. To remove as needed at least a single book case 2 from the stream 11 that is conveyed along the book production line 6, the deposit tray 4 is lowered from its idle position and, in the process, enters the conveyed stream 11 of cases 2 which are leaving the case bending device 3. After at least a single case 2 has been deposited on the deposit tray 4, the deposit tray 4 is raised once more and the thereon deposited case 2 is removed from the conveyed stream 11, so that the following book cases 2 can be supplied without a problem to the conveying section 9 which is arranged downstream of the case bending device 3.

Figure 4:
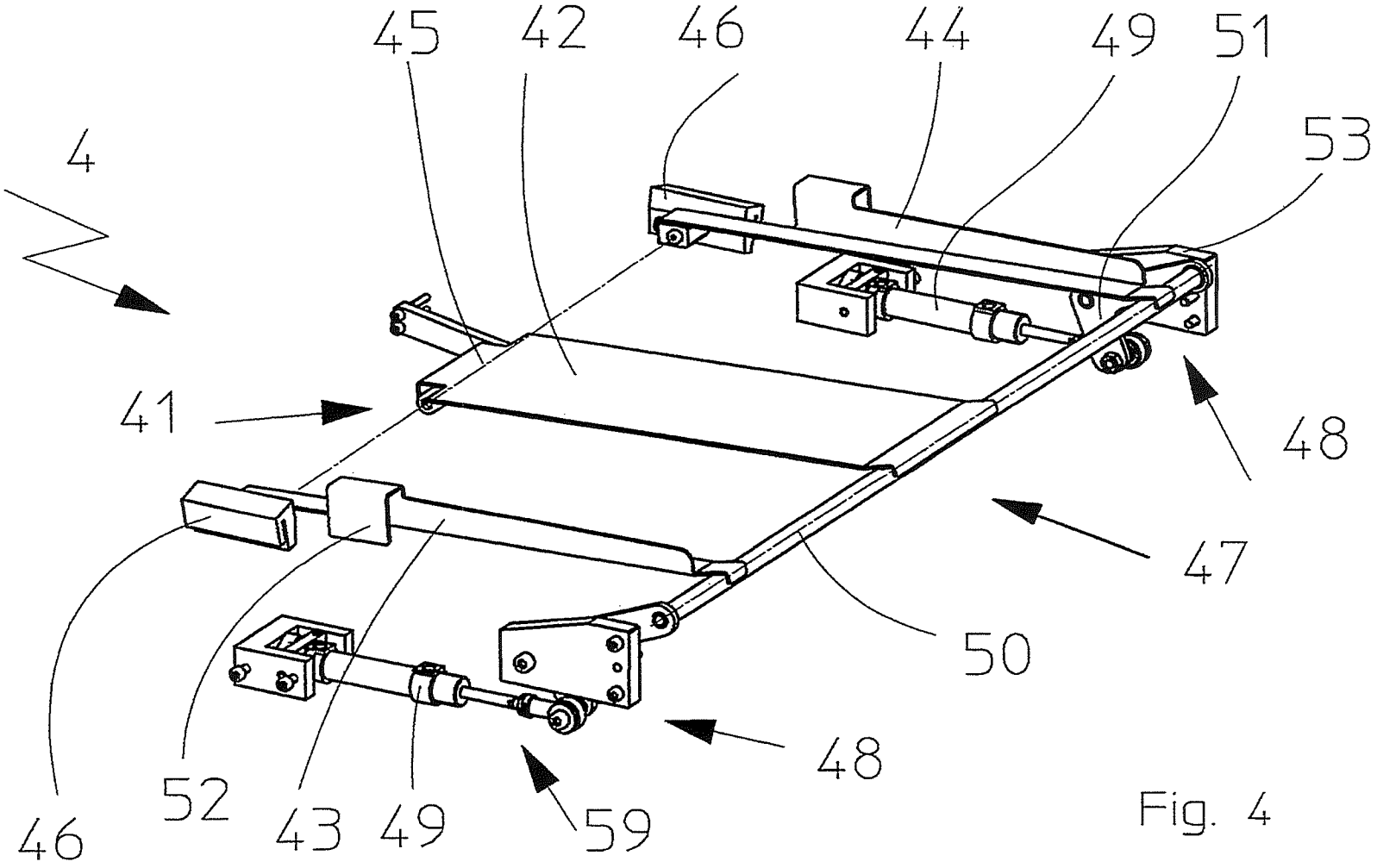
FIG. 4 is an enlarged perspective view of FIG. 2, showing a detail of the device according to the invention.
Figure 5:
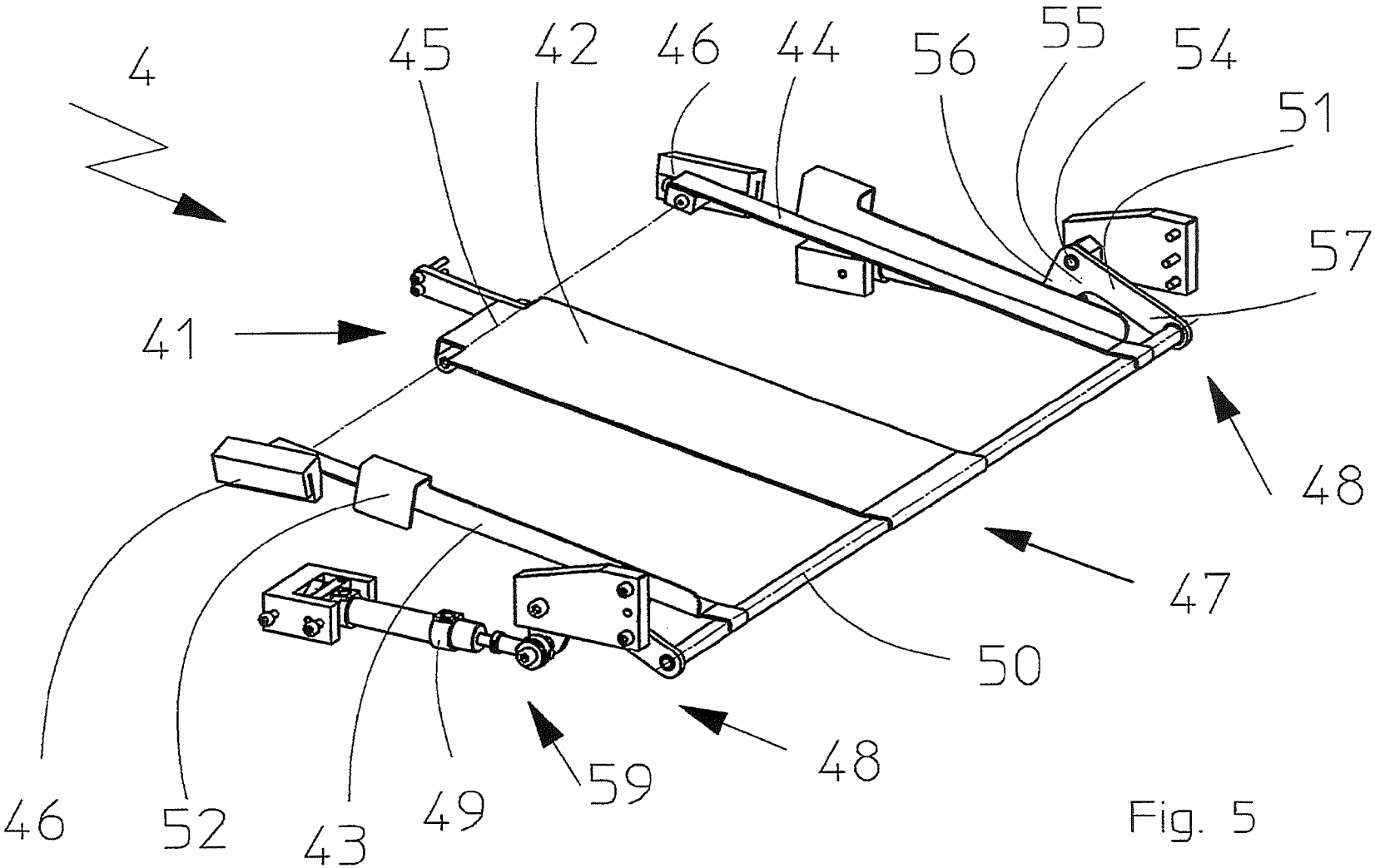
FIG. 5 is an enlarged perspective view of FIG. 3, showing a detail of the device according to the invention.

FIGS. 4 and 5 provide a view of the deposit tray 4 without the additional components of the book production line 6, where the connection between the two cylinders 49 and the rod 50 is clearly visible. An exposed end 59 of the cylinders 49 in this case faces the exposed end 47 of the deposit tray 4 while, at the other end, the cylinders 49 are connected to the book production line 6. Respectively one hinged panel 53 of a hinge mechanism 48, to which the cylinder 49 also belongs, is furthermore arranged stationary on each side of the deposit tray 4, relative to the book production line 6.

Respectively one L-shaped angle lever 51 is furthermore positioned rotating around a horizontal axis of rotation 54 in the hinged panel 53, transverse to the main transporting direction 1, which is positioned inside a bend 55 between the two legs 56, 57 of the respective angle lever 51. Facing away from the additional axes of rotation 54, the respective cylinder 49 is attached rotating to a short leg 56 of the L-shaped angle lever 51 while a long leg 57 of the angle lever 51 accommodates the rod 50 (See FIG. 5).

Figure 6:
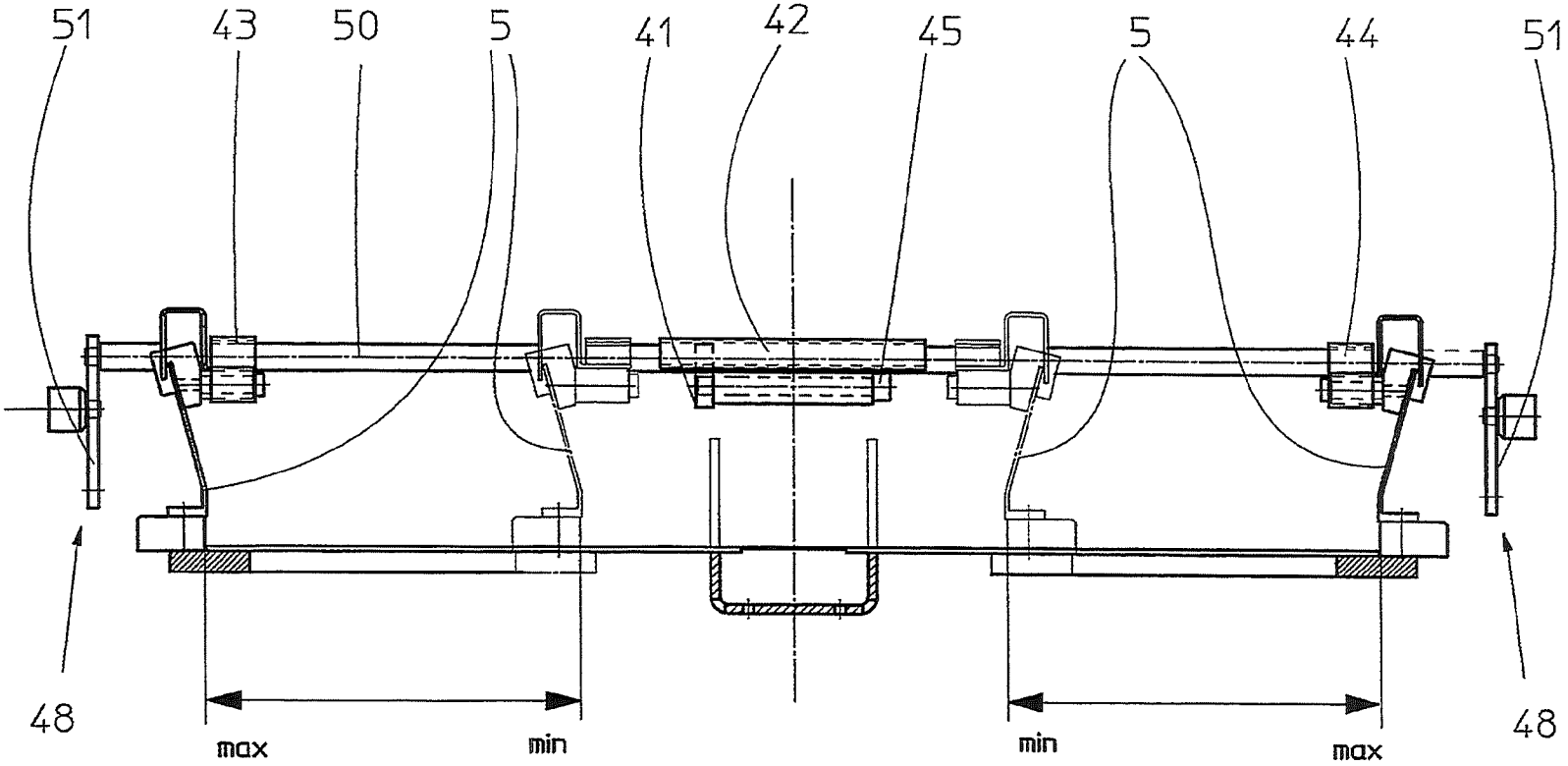
FIG. 6 is a cross-sectional view of FIGS. 2 and 3, showing the device suspended from guide plates which are shown in two positions transverse to the main transporting direction.

FIG. 6 depicts a cross-section through the book production line 6, as seen in the direction of the deposit tray 4 and counter to the main transport direction 1. The hinge mechanism 48 which accommodates the rod 50 is visible at the outer ends. The angular tray sections 43, 44 are on the outside and the center tray section 42 is positioned in the center of the rod 50.

The guide plates 5 shown in FIG. 6, illustrated by a solid line, are located in a maximum outer position. The dashed lines show the guide plates 5 while these are moved toward the inside and to a minimum position, transverse to the main transporting direction 1, where this clearly illustrates the flexibility of the deposit tray 4 with respect to different case formats (maximum; minimum).

According to one embodiment, all components of the deposit tray 4 can be inserted or placed onto a book production line 6 without requiring extensive assembly expenditure.

Another embodiment initially involves the identification of a marking 62 on the book blocks 61 as well as the book cases by an identification device 63 and the removal of a book case 2 in dependence on an evaluation, evaluated in the machine control 58 for the book production line 6, of the previously made identification. The marking 62 on the cases 2 which can be a marking applied additionally to the cases 2 as well as a marking based on the characteristics of the book cases 2, for example, the dimensions, the material, or the print image.

Following the supplying of a stack 8 of book cases 2 and a number of book blocks 61 to the book production line 6, the machine control 58 assigns to this stack 8 of book cases 2 a dataset, stored in the machine control 58, for the sequence of the book cases 2 in this stack 8, based on the marking 62 identified by the identification device 63 on the at least one book case 2 in the supplied stack 8.

Owing to the marking 62 identified on the supplied book block 61, a sequence for these book blocks 61 is determined in the machine control 58 and is then compared to the dataset for the sequence of the book cases 2. As a result of this comparison, and if at least one book block 61 is missing, relative to the sequence of the book cases 2, the machine control 58 triggers the removal of a book case 2 that corresponds to the at least one missing book block 61.

The book cases 2 leave the case bending device 3 on a trajectory, so that if the deposit tray 4 (See FIG. 3) is lowered to the catching position, one book case 2 after another is deposited on the deposit tray 4, with the last book cover 2 being positioned on the top, until the deposit tray is again raised to the idle position (See FIG. 2). In this way, one or more book cases 2 can be removed with the aid of the deposit tray 4 from the conveyed stream 11.

In this embodiment, the short legs 56 of the angle levers 51 are moved with the aid of the hinge mechanism 48 in the direction of the case bending device 3 during the outward movement of the cylinders 49. As a result, the long legs 57 of the angle levers 51 tilt with the rod 50 in an upward direction and the deposit tray 4 is then in the idle position (See FIGS. 2 and 4). For the reverse operation, the retracting of the cylinders 49 leads to the lowering of the deposit tray 4 to the catching position, meaning to the removal of at least one book case 2 from the conveyed stream 11 (See FIGS. 3 and 5).

In the idle position of the deposit tray 4, the book cases 2 move or drop below the deposit tray 4 completely unhindered onto the conveying section 9 (See FIG. 1). The conveying section 9 takes over the book cases 2 so they are positioned between the guide plates 5 which are arranged parallel to the main transporting direction 1 on the side of the book cases 2. The guide plates 5 can be moved format-dependent in a direction transverse to the transporting direction 1.

According to another embodiment, not shown herein, the at least one book case 2 may be removed from the conveying section 9 or at another position along the book production line 6. For this, the book cases 2 are not removed from the conveyed stream 11 while on a trajectory, but while positioned flat on the book production line 6, where suitable shearing plates or suction devices are arranged for this. The at least one book case 2, removed in this way, may then supplied to a deposit tray.

It will be understood that the above description of the present invention is susceptible to various modifications, changes and adaptations, and that the same are intended to be comprehended within the meaning and range of equivalents of the appended claims.

What is claimed is:

1. A method for production of books, wherein the books include at least one book block and a book case that protects the book block, comprising:

supplying a stack of book cases, arranged in a sequence, in a stream along a book production line in a main transporting direction;

supplying a plurality of book blocks successively along the book production line;

identifying a marking on each of the book blocks and book cases;

transmitting an identified marking on at least one book case to a machine control of the book production line;

correlating, as a result of the marking on the at least one book case, a dataset stored in the machine control for the sequence of book cases in the supplied stack, with the supplied stack, wherein the correlating of the dataset is done by one of the machine control or an operator;

determining, based on the identified markings of the supplied book blocks, a sequence in the machine control for book blocks positioned on the book production line;

comparing the dataset for the sequence of the book cases to the sequence of the book blocks; and if, based on the comparison, at least one book block is missing, relative to the sequence for the book cases, removing at least one book case from the stream of book cases that corresponds to the at least one missing book block, using the machine control.

2. The method according to claim 1, further comprising bending the at least one book case prior to the removal of the at least one book case.

3. The method according to claim 1, further comprising moving a deposit tray into the stream of book cases on the book production line to remove the at least one book case from the stream, wherein the removal occurs as the at least one book case drops out of a processing device along the book production line.

4. A combination comprising:

a book case processing portion of a book production line including a conveyor positioned to receive and convey a stream of book cases in a main conveying direction along the book case processing portion of the book production line; and a device for removal of at least one book case from the stream of book cases, wherein the device comprises:

a deposit tray that is positioned to be extendible into the stream to remove the at least one book case from the stream of book cases prior to being received by the conveyor;

wherein the deposit tray is essentially rectangular-shaped;

wherein the deposit tray includes an exposed end in an upstream direction of the main conveying direction and an attachment end in a downstream direction of the main conveying direction; and wherein the attachment end of the deposit tray is positioned along the book case processing portion of the book production line so that the deposit tray is moveable between an upper idle position in which the exposed end of the deposit tray is lifted and does not come in contact with the conveyed stream of book cases, and a lowered catching position in which the exposed end of the deposit tray is lowered to make contact with the conveyed stream of book cases.

5. The combination according to claim 4, wherein the deposit tray comprises:

a center tray section, and two angular support sections arranged adjacent to and on opposite sides of the center tray section, wherein the center tray section and the two angular support sections are oriented parallel to the main conveying direction when the deposit tray is in the upper idle position.

6. The combination according to claim 5, wherein the attachment end of the deposit tray includes an axis of rotation that is perpendicular to the main conveying direction for the rotated positioning of the deposit tray.

7. The combination according to claim 4, further comprising two adjustable bearings to couple the attachment end of the deposit tray to the book production line, wherein the adjustable bearings are adapted to displace the deposit tray in a linear direction and parallel to the main conveying direction.

8. The combination according to claim 7, further comprising two guide plates that are coupled to the deposit tray, wherein the deposit tray is suspendable, using the two adjustable bearings, from the guide plates, and wherein the spacing between the two guide plates is adjustable to accommodate different sizes of book cases.

9. The combination according to claim 4, further comprising a hinge mechanism that is adapted to fit the exposed end of the deposit tray, wherein the hinge mechanism is adapted to rotate the deposit tray towards and away from the conveyed stream of book cases.

10. The combination according to claim 9, wherein the hinge mechanism comprises at least one cylinder that is positioned in a plane that is both parallel to the main conveying direction and perpendicular to the deposit tray, wherein the at least one cylinder includes an exposed end that faces the exposed end of the deposit tray.

11. A book production line including the combination according to claim 4.

12. A method for removal of at least one book case from a stream of book cases conveyed in a main conveying direction along a book case processing portion of a book production line, comprising utilizing the combination according to claim 4.

* * * * *